US007810351B2

(12) United States Patent
Westermeyer

(10) Patent No.: US 7,810,351 B2
(45) Date of Patent: Oct. 12, 2010

(54) MULTIPLE OUTLET VERTICAL OIL SEPARATOR

(76) Inventor: Gary W. Westermeyer, 1440 State Route 100, Bluffs, IL (US) 62621

( * ) Notice: Subject to any disclaimer, the term of this patent is extended or adjusted under 35 U.S.C. 154(b) by 1014 days.

(21) Appl. No.: 11/263,403

(22) Filed: Oct. 31, 2005

(65) Prior Publication Data

US 2006/0196221 A1 Sep. 7, 2006

Related U.S. Application Data

(63) Continuation-in-part of application No. 11/070,595, filed on Mar. 2, 2005, now abandoned.

(51) Int. Cl.
*F25B 43/02* (2006.01)

(52) U.S. Cl. ..... 62/470; 62/473

(58) Field of Classification Search ..... 62/470, 62/471, 473, 510; 210/188, 299, 303; 96/219, 96/220

See application file for complete search history.

(56) References Cited

U.S. PATENT DOCUMENTS

| | | | | |
|---|---|---|---|---|
| 2,511,967 | A | 6/1950 | Campbell | |
| 3,021,689 | A | 2/1962 | Miller | |
| 3,304,697 | A | 2/1967 | Ramsey | |
| 3,778,984 | A | 12/1973 | Lawser | |
| 4,263,029 | A | 4/1981 | George | |
| 4,282,717 | A | 8/1981 | Bonar | |
| 4,319,459 | A * | 3/1982 | Hannett et al. | 62/77 |
| 4,478,050 | A | 10/1984 | DiCarlo et al. | |
| 4,503,685 | A | 3/1985 | DiCarlo et al. | |
| 4,506,523 | A | 3/1985 | DiCarlo et al. | |
| 4,589,263 | A | 5/1986 | DiCarlo et al. | |
| 4,690,759 | A | 9/1987 | Mandy | |
| 5,113,671 | A | 5/1992 | Westermeyer | |
| 5,134,856 | A | 8/1992 | Pillis et al. | |
| 5,271,245 | A | 12/1993 | Westermeyer | |
| 5,404,730 | A * | 4/1995 | Westermeyer | 62/470 |
| 5,502,984 | A | 4/1996 | Boehde et al. | |
| 5,542,499 | A | 8/1996 | Westermeyer | |
| 5,551,253 | A | 9/1996 | Kim | |
| 5,553,460 | A | 9/1996 | Isaacs | |
| 5,645,124 | A * | 7/1997 | Hartfield et al. | 165/117 |

(Continued)

FOREIGN PATENT DOCUMENTS

| | | | |
|---|---|---|---|
| DE | 3705850 | A1 * | 9/1988 |

OTHER PUBLICATIONS

Abstract to DE 3705850 Al to Angelmann et al.*

(Continued)

*Primary Examiner*—Mohammad M Ali
(74) *Attorney, Agent, or Firm*—Senniger Powers LLP

(57) ABSTRACT

An oil separator for separating oil from a refrigerant gas and oil mixture on the high side of a refrigeration/chiller system comprising, a housing having an upper chamber with an inlet for the refrigerant gas and oil mixture, and having a refrigerant gas outlet therefrom, the outlet conduit being connected to multiple outlets for delivery of refrigerant gas to multiple condenser circuits in the system, and said housing also having a lower chamber with an oil outlet therefrom, and at least one oil filter in said upper chamber for removing oil out of the mixture for transfer to the lower chamber.

20 Claims, 11 Drawing Sheets

U.S. PATENT DOCUMENTS 5,713,985 A 2/1998 Hamilton
6,164,458 A 12/2000 Mandrin
6,214,071 B1 4/2001 Wang
6,467,303 B2 * 10/2002 Ross ..... 62/509
6,519,971 B1 * 2/2003 Kim ..... 62/503

OTHER PUBLICATIONS

Gary W. Westermeyer, Boosting Efficiencies Using Oil Separation, pp. 236-246, published May, 1998.

* cited by examiner

MULTIPLE OUTLET VERTICAL OIL SEPARATOR

CROSS-REFERENCE TO RELATED APPLICATION

This is a continuation-in-part of U.S. application Ser. No. 11/070,595 filed Mar. 2, 2005 for VERTICAL OIL SEPARATOR, the entire disclosure of which is incorporated herein by reference.

FIELD OF THE INVENTION

The present invention relates generally to the commercial and industrial refrigeration art. More particularly, the invention is directed to improvements in vertical oil separators for efficiently separating oil and refrigerant gas on the high side of a refrigeration system.

DESCRIPTION OF THE PRIOR ART

The maintenance of lubricating oil in refrigeration system compressors is critical to the efficient operation and life span thereof. Clearly a compressor is the principal driving force in any refrigeration or chiller system—it compresses refrigerant gas and discharges it on its high pressure side to a condenser in which the gas is condensed to a liquid phase, and thence it passes to the evaporator or like cooling coil of the system through an expansion device reducing the refrigerant pressure and permitting absorption of heat and expanding the liquid phase gas back to a gaseous phase on the low suction side of the compressor. All types of compressors—reciprocating, screw, scroll, centrifugal—employed in refrigeration systems use oil as a lubricant and sealant, and during operation some amount of this oil is entrained in the hot compressed refrigerant vapor outflow discharged on the high side to operate the system.

It is clear that the lubricating oil serves no useful purpose outside the compressor. Oil does not have as good heat transfer capability as the refrigerant and will reduce the efficiency of the condenser and evaporator functions. Although some amount of oil is generally present throughout the system, it is important to return most of it back to the compressor for its safe and efficient operation and to prevent oil from building up in other system components. The importance of good compressor lubrication cannot be overemphasized; and it may be noted that a typical screw compressor, for instance, may require several gallons of oil per minute.

In the past, high side oil traps or separators have been employed to separate out the oil from the refrigerant gas in route from the compressor to the condenser. Such oil separators, as discussed in U.S. Pat. Nos. 4,478,050; 4,506,523; 5,133,671; and 5,271,245, are known for separating oil from the high side refrigerant gas and oil mixture, but these and other prior oil separators are deficient in performance, cost, size, system complexity and other limiting factors.

Thus it is important to provide an oil separator that provides distinctive improvements in efficient oil separation performance, simplicity of design for manufacturing cost reduction and for installation and maintenance ease.

SUMMARY OF THE INVENTION

The invention is embodied in a vertical oil separator for separating oil from a refrigerant gas and oil mixture on the high side of a refrigeration/chiller system having multiple condenser circuits, comprising a vertical housing having an upper oil separation chamber constructed to separate the gas from the oil and said housing having a refrigerant gas discharge chamber in communication with the separation chamber for receiving the gas therefrom, the housing also having a lower oil collection chamber below the upper chamber with an oil outlet therefrom, and said gas discharge chamber being constructed with at least two refrigerant gas outlets connected to discharge the refrigerant gas to the multiple condenser circuits.

The principal object of the invention is to provide an oil separation system having a highly efficient oil-refrigerant separator section and a liquid oil reservoir section. Thus, in one aspect of the invention an oil and gas mixture inlet is tangentially arranged in an upper separation section to impart a swirling action impinging the mixture by centrifugal force against and through a screen liner to remove the oil, a refrigerant gas discharge is arranged with dual outlets in the upper section, a transverse baffle divides the upper section from a lower oil accumulation reservoir, the baffle effectively confines centrifugal vortex action to the upper section and keeps the lower oil collection reservoir relatively static while providing a nonrestricting passageway for oil flow to the lower section, and an oil outlet is provided for removing oil from the lower section.

Another object is to provide an efficient, easily serviced and economic oil system for a compressor driven refrigeration/chiller system having multiple condenser circuits. Thus, in another aspect of the invention the incoming high pressure oil-refrigerant gas mixture is given a high degree of centrifugal action to separate out the oil on a collection device in an upper inlet section. Such turbulent action is substantially eliminated from a lower liquid oil accumulator section by a dividing baffle, and the refrigerant gas is removed through multiple discharge outlets to condenser means having multiple circuits.

In another aspect, the oil separator invention provides an upper oil-gas mixture separation section with a tangential inlet to impart centrifugal action, an oil collection and transfer device has primary and secondary components to separate oil from the refrigerant gas and transfer it in liquid form, a centrally-disposed gas discharge removes refrigerant through multiple outlets; and; a lower oil accumulator section receives liquid oil from the primary and secondary collection members; for return to the compressors.

These and other objects and advantages will become more apparent hereinafter.

BRIEF DESCRIPTION OF THE DRAWINGS

For illustration purposes, together with the accompanying written disclosure, the invention is embodied in the parts and the combinations and arrangements of parts hereinafter described. In the drawings, wherein like numerals refer to like parts wherever they occur.

DESCRIPTION OF THE PREFERRED EMBODIMENTS

Figure 1:
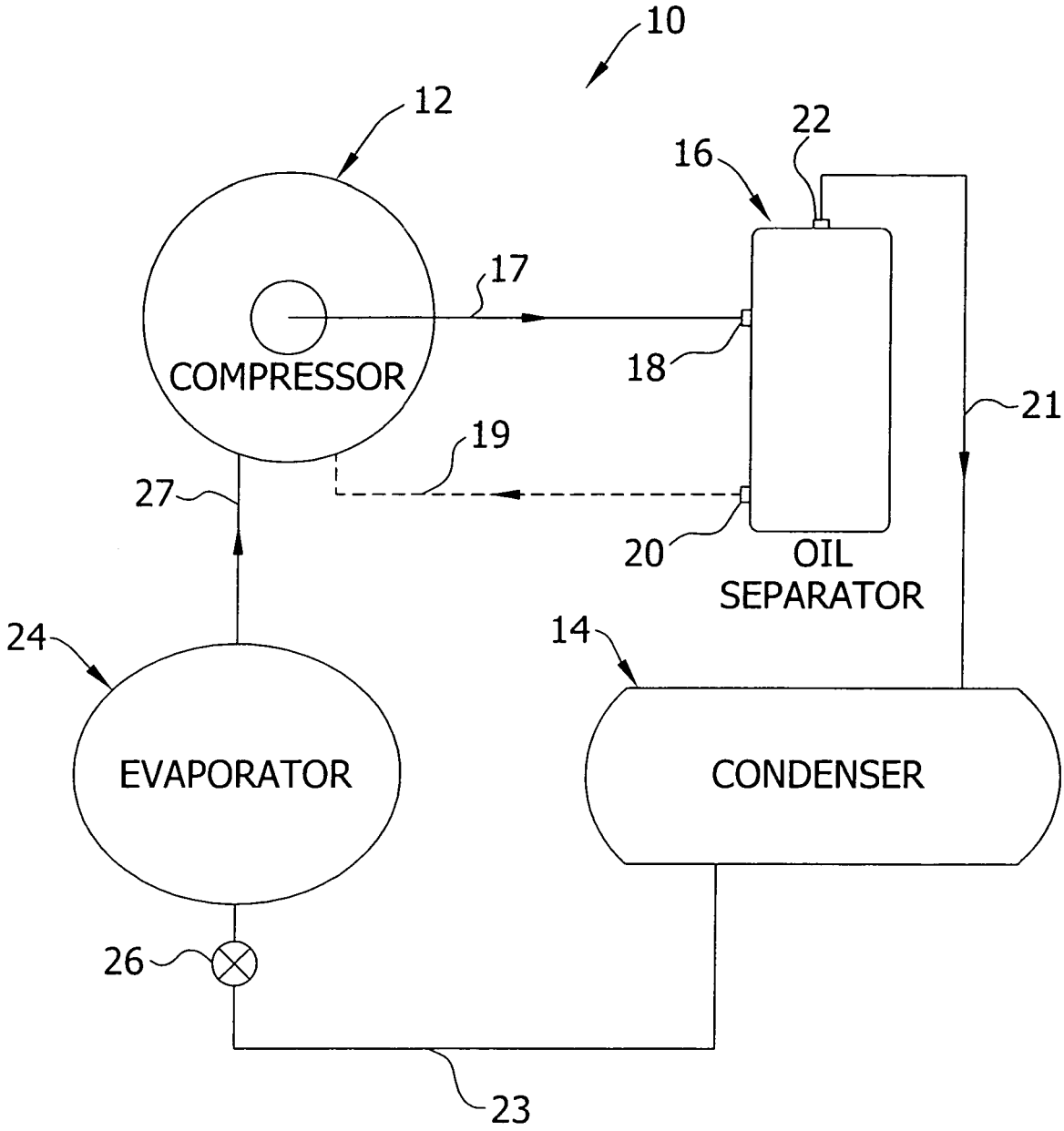
FIG. 1 is a diagrammatic view of a basic refrigeration or chiller system incorporating the invention.

For the purposes of disclosure, a closed refrigeration or chiller system 10 includes a compressor 12 connected on its high pressure outlet side to a condenser 14 through an oil separator 16 embodying the invention. Typically the compressor 10 requires a large amount of lubricating and cooling oil in operation, and such oil is entrained in the hot compressed refrigerant to form an oil-gas mixture that is discharged on the compressor high side through conduit 17 to the oil separator inlet 18. It has been reported that the oil content in the oil and refrigerant gas mixture from a chiller system compressor is over 50,000 ppm (parts per million). The compressor 12 is also in fluid communication with the oil separator 16 through an oil return conduit 19 from oil outlet 20 through which oil is returned to and maintained in the compressor at a preselected level by a conventional oil level regulator (not shown) or the like. The condenser 14 is connected in fluid communication with the oil separator 16 through a refrigerant gas conduit 21 from the gas outlet 22. The hot compressed refrigerant gas (and a minor, acceptable amount of entrained oil) passes through conduit 21 to condenser 14 in which it is cooled and condensed into a high pressure liquid phase. The condenser 14 connects through conduit 23 to an evaporator 24 or like heat exchanger through an expansion valve 26. Refrigerant liquid is caused to expand and absorb heat to provide refrigeration. In a chiller system this heat exchange takes place between the expanding liquid refrigerant and a chilled liquid whereas in a typical commercial refrigeration system the expanding refrigerant absorbs heat from a circulating airflow that cools a space or product zone. In either case the refrigerant liquid absorbs latent heat and changes to a gaseous phase, and is returned to the compressor 12 on its low side through suction conduit 27 to complete the refrigeration cycle.

Figure 2:
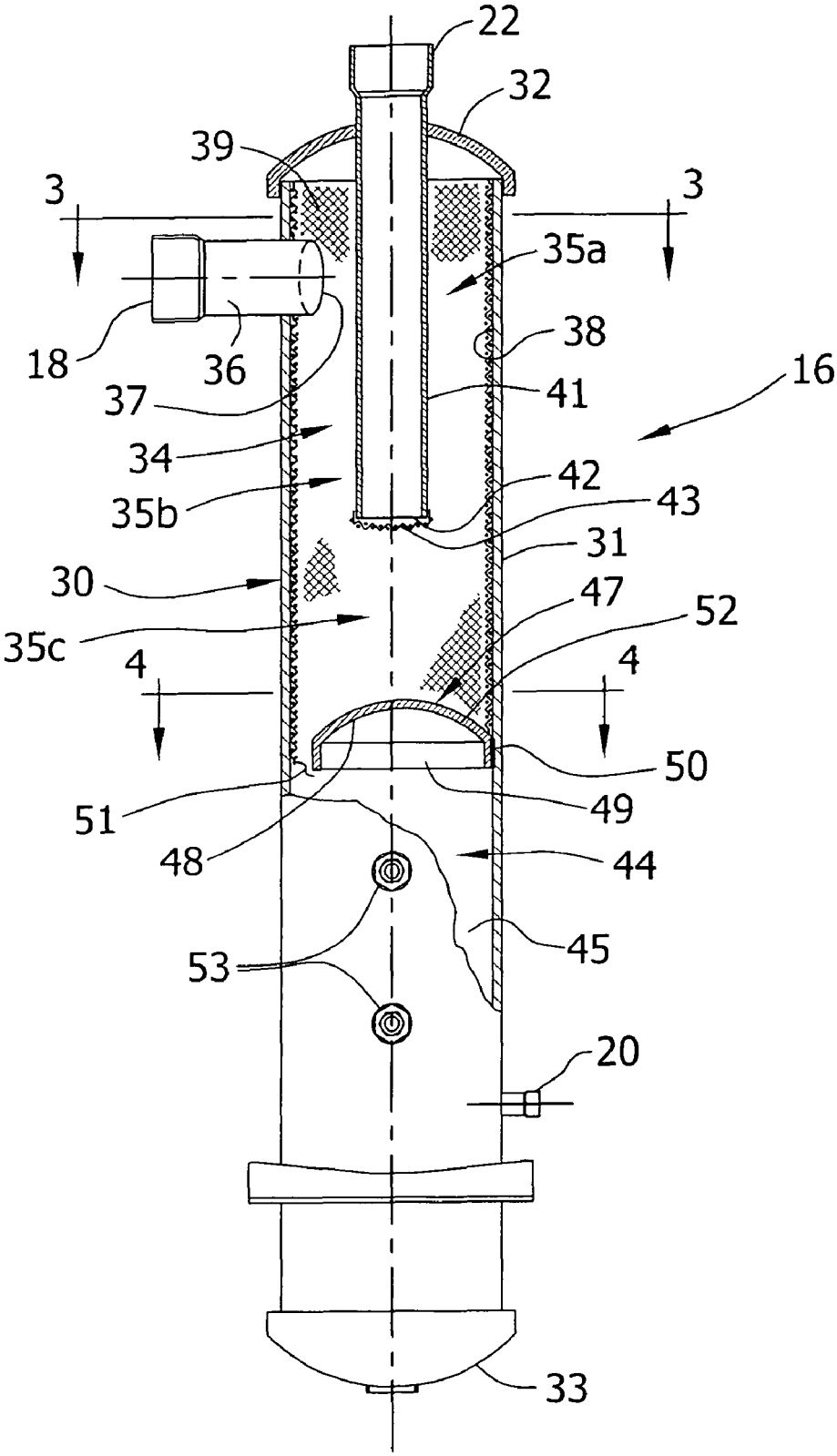
FIG. 2 is an enlarged cross-sectional side view showing one embodiment of a vertical oil separator embodying the invention.
Figure 3:
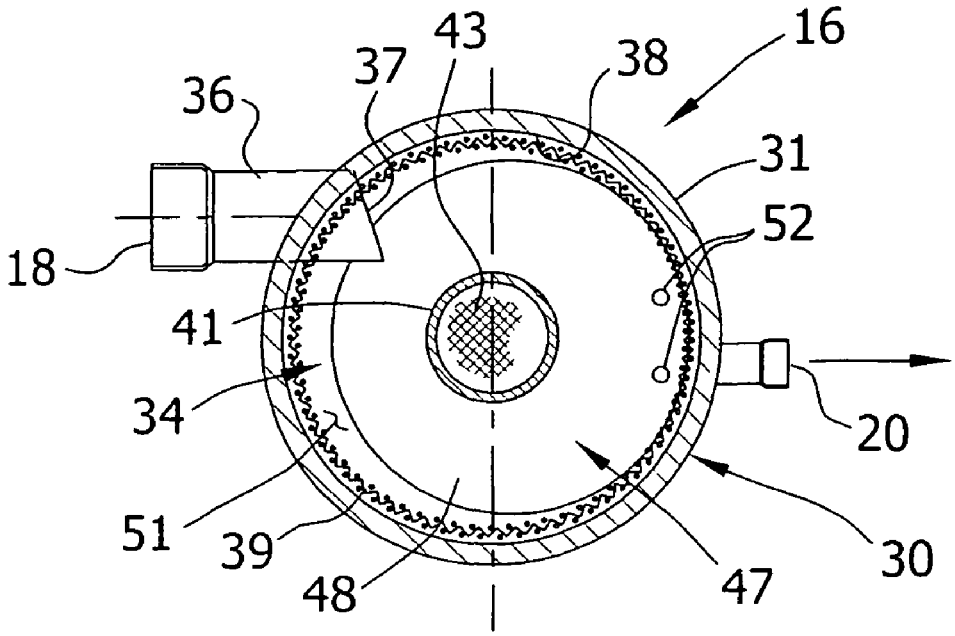
FIG. 3 is a cross-sectional view thereof taken along line 3-3 of FIG. 2.
Figure 4:
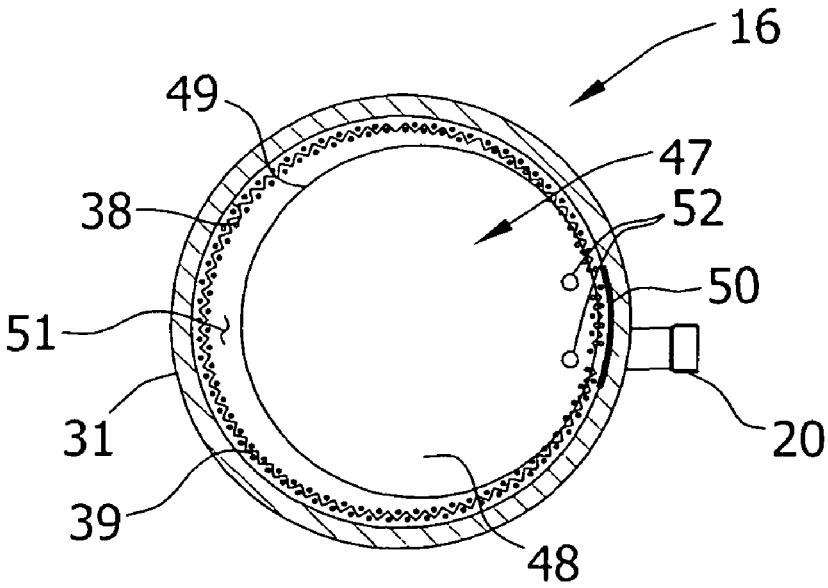
FIG. 4 is a cross-sectional view thereof taken along line 4-4 of FIG. 2.

Referring now to FIGS. 2-4, in its simplest form the oil separator 16 has an elongated vertical main housing 30 having a generally cylindrical outer wall 31 with an upper end cap 32 and a lower end cap 33 and forming a closed vessel. An upper section 34 of the vessel forms an upper vapor receiving and oil separating chamber having vertically contiguous upper, intermediate and lower zones 35*a*, 35*b* and 35*c*, respectively. An inlet conduit 36 from inlet 18 is tangentially positioned in the upper zone 35*a* of the separator chamber and has a beveled or angled discharge opening 37 facing toward the adjacent inner surface 38 of the wall 31 to create an optimum circulating flow path and centrifugal vortex action of the oil-refrigerant vapor mixture entering the upper section 34. An oil separating and collecting member 39 in the form of a cylindrical screen or like open mesh, wire cloth member is disposed next to the inner wall surface 38, and, in this embodiment, extends vertically through the length of the upper chamber 35. Preferably this screen member 39 is about 20 mesh steel wire cloth with a 0.016 wire diameter or the like that provides a large surface area to induce adherence of oil particles. In short, the oil-gas mixture enters the upper chamber zone 35(*a*) at a high velocity and head pressure creating a spinning circular flow path with vortex action that impinges against this first oil filtering screen liner 39 in which oil particles are pushed into and forced through the screen mesh. Thus, oil particles accumulate on and through the screen member 39 and build up in liquid form to drain downwardly along the inner wall surface 38.

A refrigerant vapor outlet conduit 41 is centrally disposed within the upper section 34 and connects to the outlet 22 in the refrigerant circuit to the condenser 14. As shown best in FIG. 2, this discharge outlet conduit has a gas intake end 42 positioned in the intermediate zone 35*b* substantially below the level of the oil-gas mixture inlet conduit 36 to thereby provide a substantial vertical expanse of the oil filtering screen liner 39 thereabove to optimize oil removal by centrifugal action as the refrigerant vapor circles downwardly to and below the intake level (42) of the refrigerant gas outlet conduit 41. Another or final screen filter 43 may be attached to cover the intake end 42 of the outlet conduit 41 within the circulating flow path to thereby enhance final oil separation from the refrigerant gas even at reduced compressor operating capacities.

The main housing 30 of the oil separator 16 also defines a lower oil collection section 44 forming a reservoir chamber 45 for accumulating and storing a supply of liquid oil to be returned, as needed, through oil outlet 20 to the compressor 12. Turbulence of the oil in the reservoir 45 is not desirable, and it is therefore important to render this lower chamber substantially static. To this end, a divider wall or baffle member 47 is vertically disposed in the vessel and the lower zone 35*c* of the upper chamber or section 34 forms a separation zone between the upper and lower sections 34 and 44. This baffle member 47, in one form, is an upwardly-domed, circular, dish-shaped wall 48 with a downwardly extending peripheral flange 49 and being constructed and arranged to form an effective barrier that restricts the turbulent circular vapor flow action to the upper section 34, and primarily the upper and intermediate zones 35*a*, 35*b* thereof, while accommodating the free downward passage of liquid oil from the upper section 34 to the lower oil collecting section 44. As shown in FIGS. 2-4, the baffle 47 is asymmetrically mounted in the main housing with its flange wall 49 attached at one side, as by interior welding 50, to the inner side wall 38. The baffle may be attached by bolts, rivets or the like if sealed to maintain the internal integrity of the high pressure vessel housing against leakage. This off-center disposition results in a larger and unrestricted oil passageway 51 being formed between the flange wall 49 and vessel wall 38 on the opposite side—the passageway 51 thence narrowing in a closing arc, around the flange periphery to the welded attachment edge of the baffle (at 50). Additional oil drain holes 52 may be provided in the upwardly domed wall surface 40 at the flange attachment point to prevent any entrapment of oil by the baffle member 47. The oil separator 16 may also be provided with an oil reservoir sight glass (not shown) mounted at upper and lower ports 53.

From the foregoing it will be seen that the oil separator unit of the present invention is simple in design; but highly efficient. One feature of novelty resides in the oil filtration device having a screen collection member 39 constructed and arranged to enhance the passage of oil particles therethrough while having a sufficient body depth and surface structure to hold or entrap the oil particles as they are pushed through by the pressurized gas vortex, and at least one other oil filter device (e.g. final screen filter 43) for providing optimum oil removal from the refrigerant gas upstream of its outlet 42 from the upper chamber. Thus, the oil particles amass and form a liquid oil curtain flowing down the inner chamber wall surface 38 to and around the baffle 47. Another feature is the offset, asymmetrical arrangement of the baffle that accommodates free oil passages therepast into the lower oil collection reservoir 45 and keeps it static by blocking and restricting gas turbulence to the upper section 34.

Figure 5:
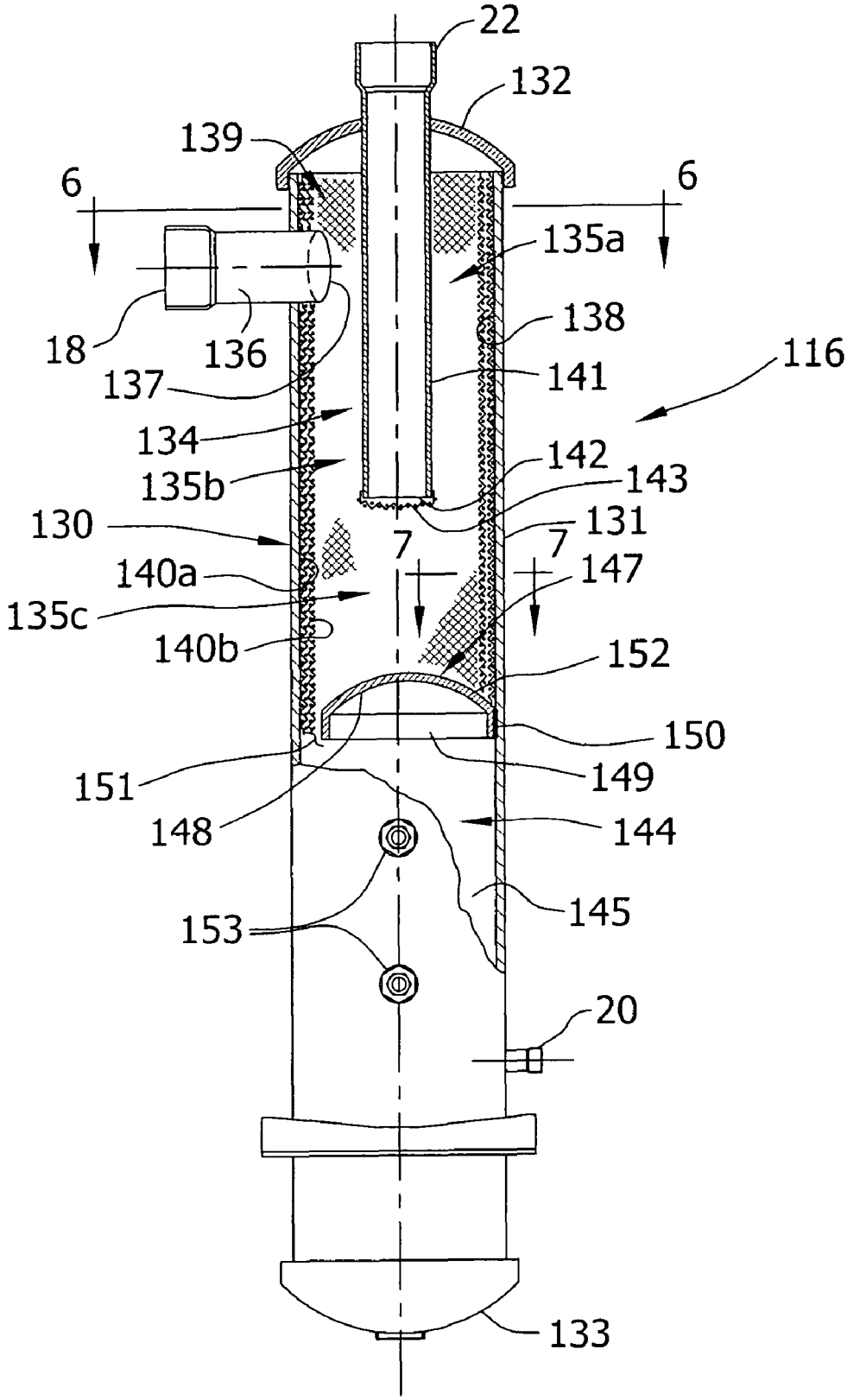
FIG. 5 is an enlarged side view similar to FIG. 2, but showing a second embodiment of the vertical oil separator.
Figure 6:
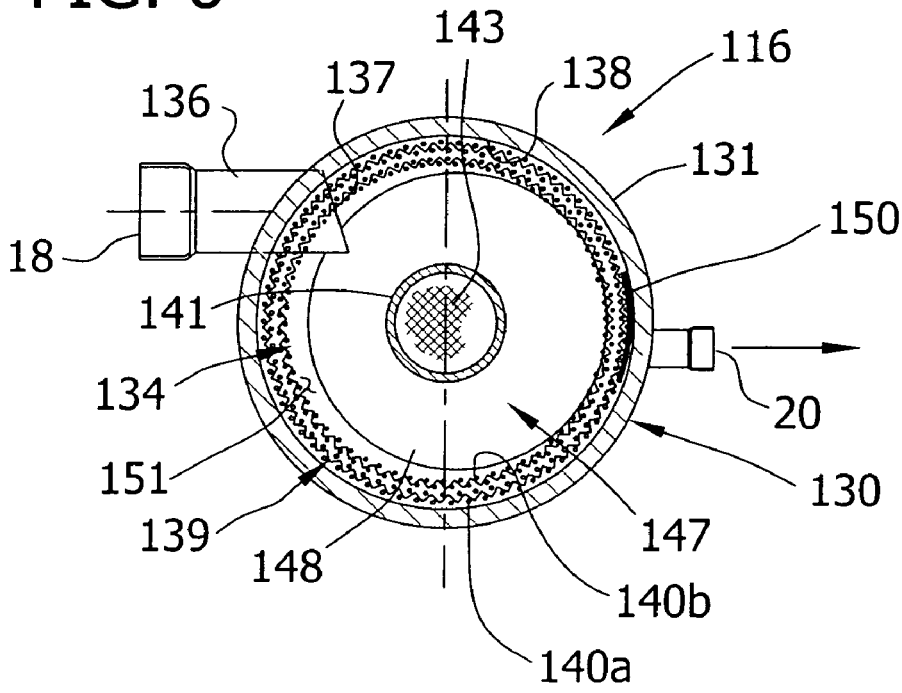
FIG. 6 is a cross-sectional view of the second embodiment taken along line 6-6 of FIG. 5.
Figure 7:
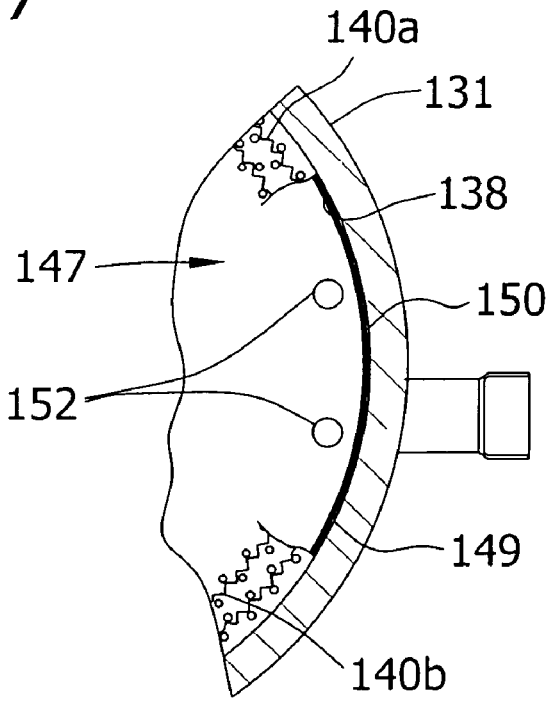
FIG. 7 is a greatly enlarged fragmentary view, partly broken away, illustrating the second embodiment and taken along line 7-7 of FIG. 5.

Referring to FIGS. 5-7, a presently preferred embodiment of the oil separator 116 is shown with common features to that of FIG. 2 identified in the "100" numerical series. In the FIG. 5 embodiment, screen liner member 139, has a primary outer layer 140*a* of screen material in adjacent circumscribing relationship with the inner wall surface 138 and a secondary inner layer 140*b* of screen material on the inside of the outer layer 140*a*. Thus, a multi-ply or double layer wrapping of screen mesh lines the inner wall surface 138 and provides an oil collection member of substantial oil holding thickness. The oil-laden refrigerant vapor from the compressor discharge side 17 enters the oil separator 116 through inlet tube 136 and is directed from the beveled discharge opening 137 against the dual mesh liner 140*a*, 140*b* at the upper zone 135*a* of the upper oil separating section 134. The flow of higher pressure oil-gas vapor impinges against the inwardly exposed surface of the inner screen layer 140*b*, and oil particles are thus pushed into and through the openings or perforations of the screen mesh and amass as a flowable liquid on both oil filtering layers 140*a*, 140*b* and on the inner wall surface 138 of the upper chamber wall. It appears that the bulk of the oil separation will occur in the upper and intermediate zones 135*a*, 135*b* of the upper section 134, above and at the level of the gas discharge inlet 142, and the swirling centrifugal action of the less dense (oil-lightened) refrigerant vapor against the inner screen surface and acting through the dual liner-layers keeps the body of accumulated liquid oil intact and flowing downwardly to the baffle 147 and through the oil passageway 151 into the lower section 144. A final screen filter 143 (as in FIG. 2) may be provided.

Figure 8:
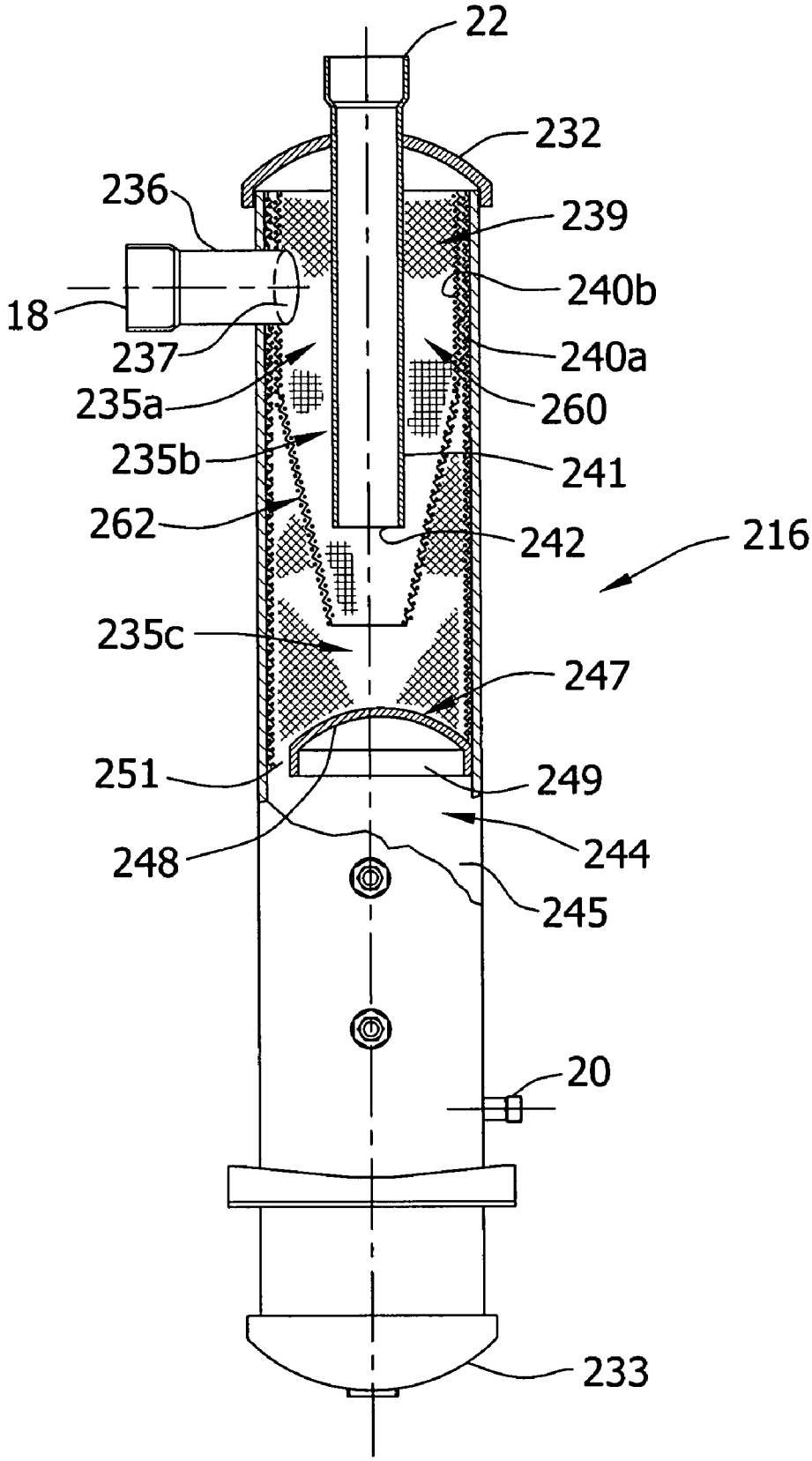
FIG. 8 is an enlarged cross-sectional side view showing a further embodiment of the invention.

Referring to FIG. 8, in a further embodiment of the invention, the multi-ply screen mesh (239) of the oil separator 216 is modified from the embodiment of FIG. 5. In FIG. 8, the outer primary screen member 240*a* is substantially the same, and is formed as a cylinder of material lining the inner wall surface 238 of the main housing wall 231 and extending from the top closure cap 232 downwardly to the baffle 247 separating the upper and lower chambers 234 and 244. The inner secondary screen member 240*b* has a cylindrical upper section (identified generally at 260) defining the vertical extent of the upper zone 235*a* and being arranged in close association within the outer liner member 240*a* and concentric therewith. The lower section of the inner screen member (240*b*) is constructed to form an elongated, downwardly narrowing, funnel 262 in the intermediate or midsection (235*b*) of the oil separation section 234. This funnel 262 extends below the refrigerant gas discharge outlet 242 and forms a secondary oil filter. In operation, the upper section 260 of the dual screen liner 239 forms the primary upper zone 235*a* of oil removal—the high pressure oil-gas vapor entering the upper oil separation chamber 235 impinges against the inner screen layer 240*b* and oil particles are thus pushed into and through the screen mesh and accumulate in liquid form. As has been seen, the high pressure refrigerant gas continues to swirl downwardly through this uppermost separation zone pushing outwardly and maintaining an oil separation action throughout this zone while inducing liquid oil to flow downwardly along the outer screen liner 240*a* and the main housing wall 238. The conically tapering funnel member 262 in the midsection 235*b* of the upper section 234 will continue to receive and hold a layer of oil that will act to constrict the vortex action of the gas and create a change in its velocity within the funnel section 262. The vortex action is relieved at the lower end 264 of the funnel 262 as the upper section 234 is again effectively widened into the lower zone 235*c* as refrigerant gas is removed upwardly in the intermediate zone 235*b* through discharge conduit 241 to the refrigeration system. The funnel 262 acts to modify the centrifugal action of the refrigerant vapor so that the oil separator is self compensating for various load conditions and changes.

Figure 9:
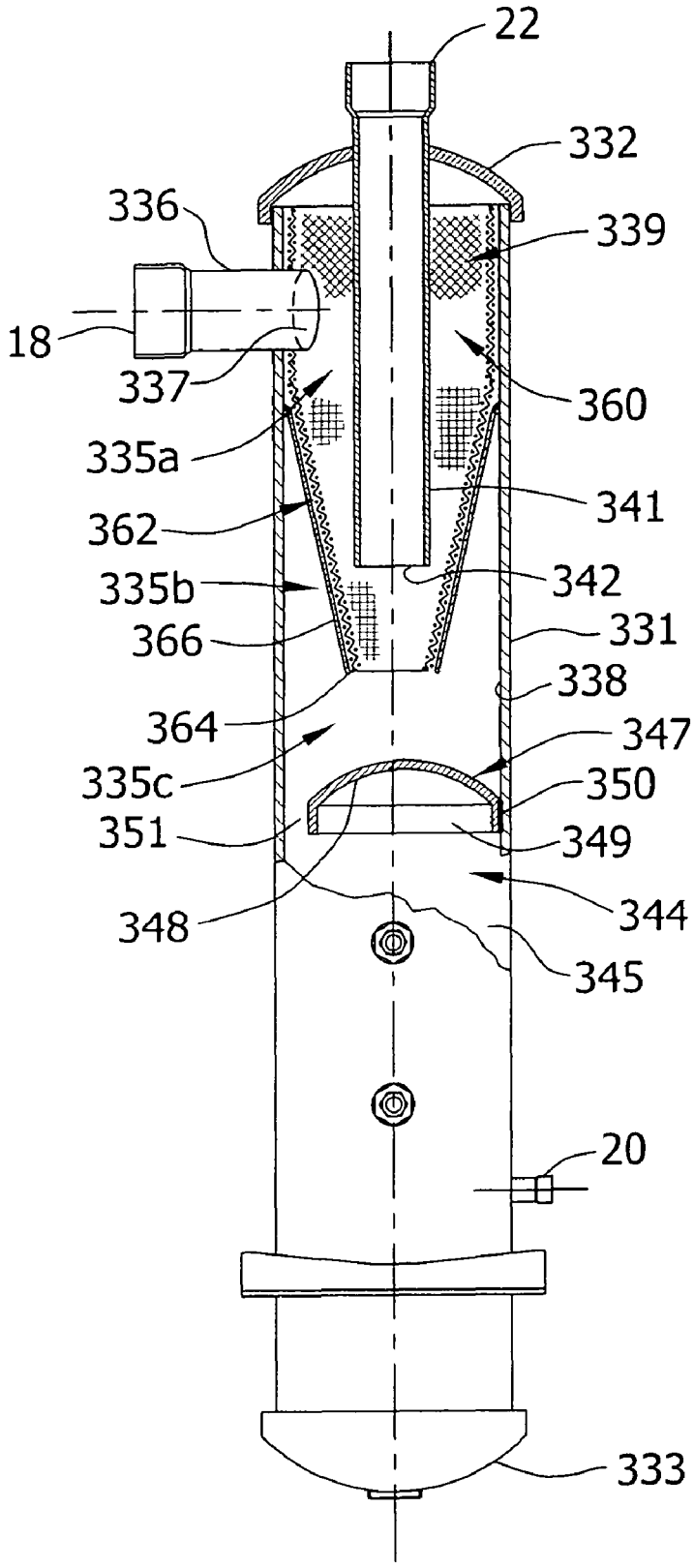
FIG. 9 is a view similar to FIG. 8, showing a simplified version of that embodiment.

Referring now to FIG. 9 showing a simplified version of the FIG. 8 embodiment, the oil separator 316 has an oil separating and collecting member 339 with a cylindrical upper screen section 360 that receives the oil-refrigerant intake flow from the system compressor (12) in the upper zone 335*a* of the upper housing section whereby centrifugal swirling action in the upper chamber takes place and oil separation is initiated. The member 339 also has a tapering, conical lower screen section 362 extending downwardly in the intermediate zone 335*b* of the upper separation chamber of the main housing 331 which extends below the refrigerant vapor discharge intake 342 of outlet conduit 341. As in FIG. 8, the lower end 364 of the conical screen wall 362 is located in the intermediate zone 335*b* above and spaced by the lower zone 335*c* from the domed baffle 347. The lower conical wall section 362 may have a funnel-shaped support structure 366, such as a sheet metal frusto-conical funnel or, preferably, an open lattice work of metal strips or the like to provide a perforate, open support structure accommodating the passage of accumulated oil therethrough. In operation the increasing velocity of the vortex action in the conical screen section 362 is relieved at the lower end 364 due to the wider open area of the lower zone 335*c* below it.

Figure 10:
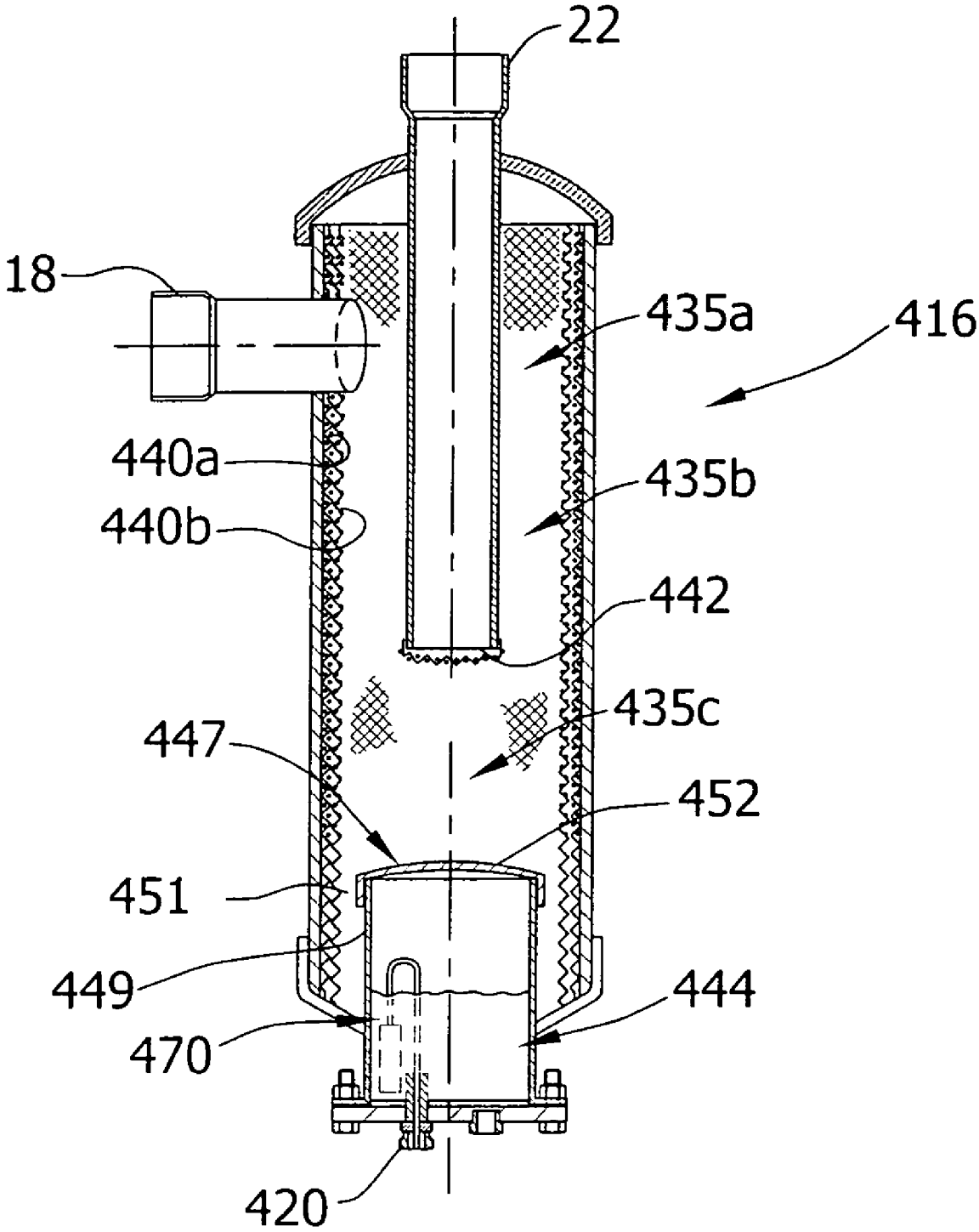
FIG. 10 is a cross-sectional view of still another embodiment.

The oil separator (16, 116, 216, 316) of the present invention may be further modified to accommodate size or space limitations of the other system components or the operational volume demands for oil. For instance in another embodiment illustrated in FIG. 10, the vertical oil separator 416 may be shortened substantially to reduce the volumetric size of the lower oil collecting section 444 and provide an oil float device 470 to deliver oil to a separate oil reservoir (not shown) connected to the oil outlet port 420. In this arrangement, the separator will hold about 1-2 pounds of oil, and the float mechanism 470 has a float ball that lifts to maintain a predetermined oil level. The lower section 444 is separated from the lower zone 435*c* of the upper section 434 by baffle 447 having an upper domed plate or top wall 452 spaced from sidewall 438 on housing member 449 to provide an oil passageway 451 therebetween. The descending oil flows through openings in the housing. First and second oil filters (440*a*, 440*b* and/or 440, 442) are provided in the upper section, as previously described.

Figure 11:
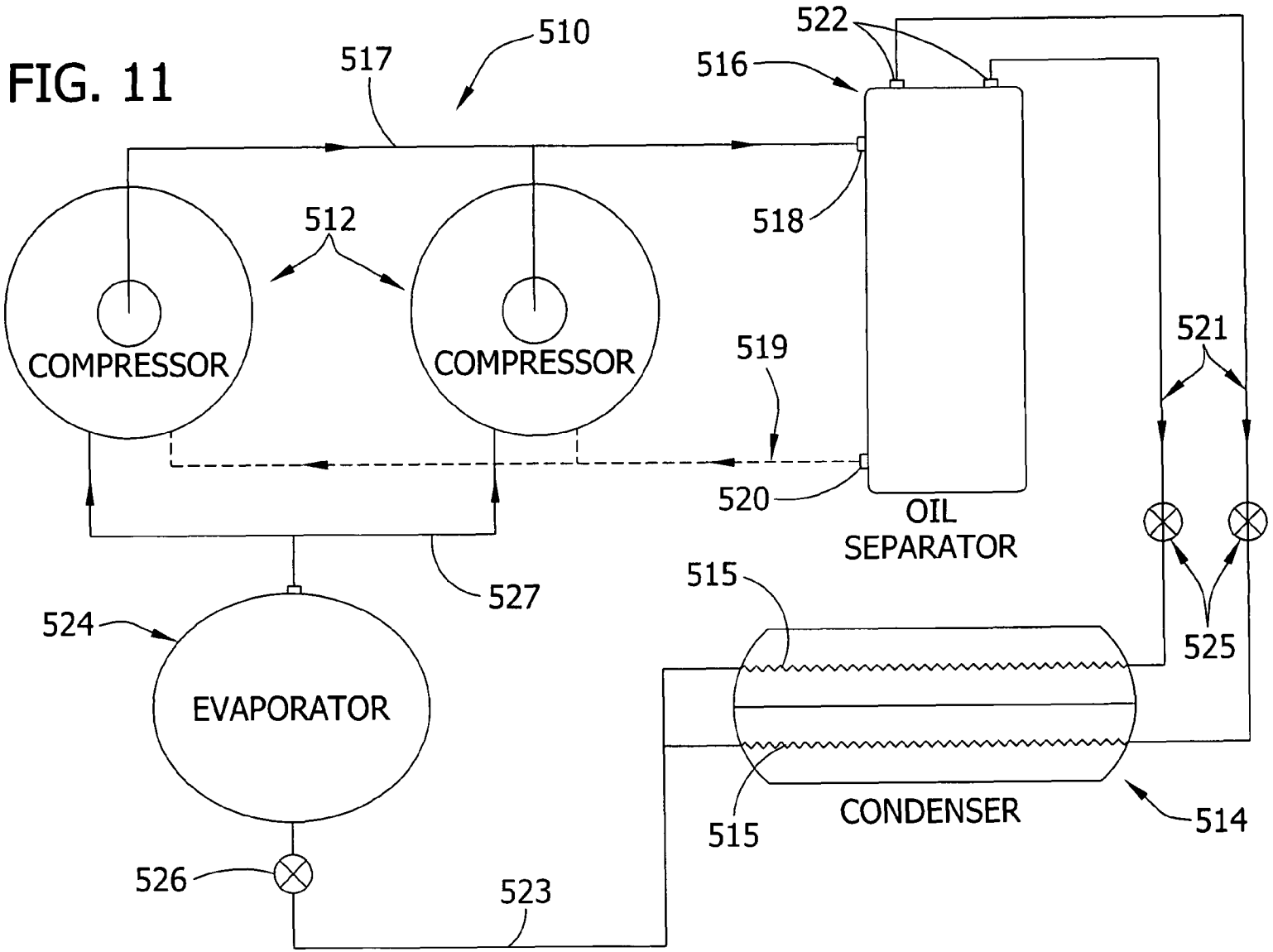
FIG. 11 is a diagrammatic view of a refrigeration/chiller system having multiple compressors and multiple condenser circuits.

Referring now to FIG. 11 it will be seen that a modified refrigeration or chiller system 510 includes parallel-piped multiple compressors 512 and a condenser 514 that has multiple parallel condensing circuits 515. The high pressure discharge of the compressors 510 passes through outlet header 517 to the inlet 518 of an oil separator 516 embodying the invention and, as shown best in FIGS. 12 and 13, this header 517 is of enlarged size to accommodate the high volumetric of refrigerant gas and oil mixture discharged by the multiple compressors 510. The compressors 510 are also in fluid communication through an oil return conduit 519 from oil outlet 520 of the oil separator 516 through which liquid oil is returned to and maintained at a predetermined level in the compressors in a typical manner.

The condenser circuits 515 are each connected through the high side conduit 521 to receive refrigerant gas from an outlet port 522 of the oil separator 516. The flow of high pressure refrigerant gas from the oil separator 516 is controlled in each line 521 by a valve 525 or other such control means to accommodate or maintain the desired condensing loads in the condenser circuits 515. Thus, the condenser circuits cool and condense the refrigerant gas into its high pressure liquid phase. The condenser circuits are connected downstream through a liquid conduit 523 and expansion valve 526 to evaporator means 524 or like heat exchanger as may typically be used in a chiller system. The expanding refrigerant in the evaporator/heat exchanger 524 changes to a gaseous phase, and is returned on the low pressure suction side of the compressors 510 through conduit(s) and a suction header 527 to complete the refrigeration cycles.

It may be noted that multiple compressor systems, whether parallel-piped or compounded, have had oil return problems and a typical solution to minimize such operational problems has been to pipe separate oil separation devices into the gas discharge conduit of each separate compressor. As will now be seen, the oil separator 516 of the present invention is constructed and arranged to obviate the prior operational problems of systems requiring multiple compressors and/or condenser circuits.

Figure 12:
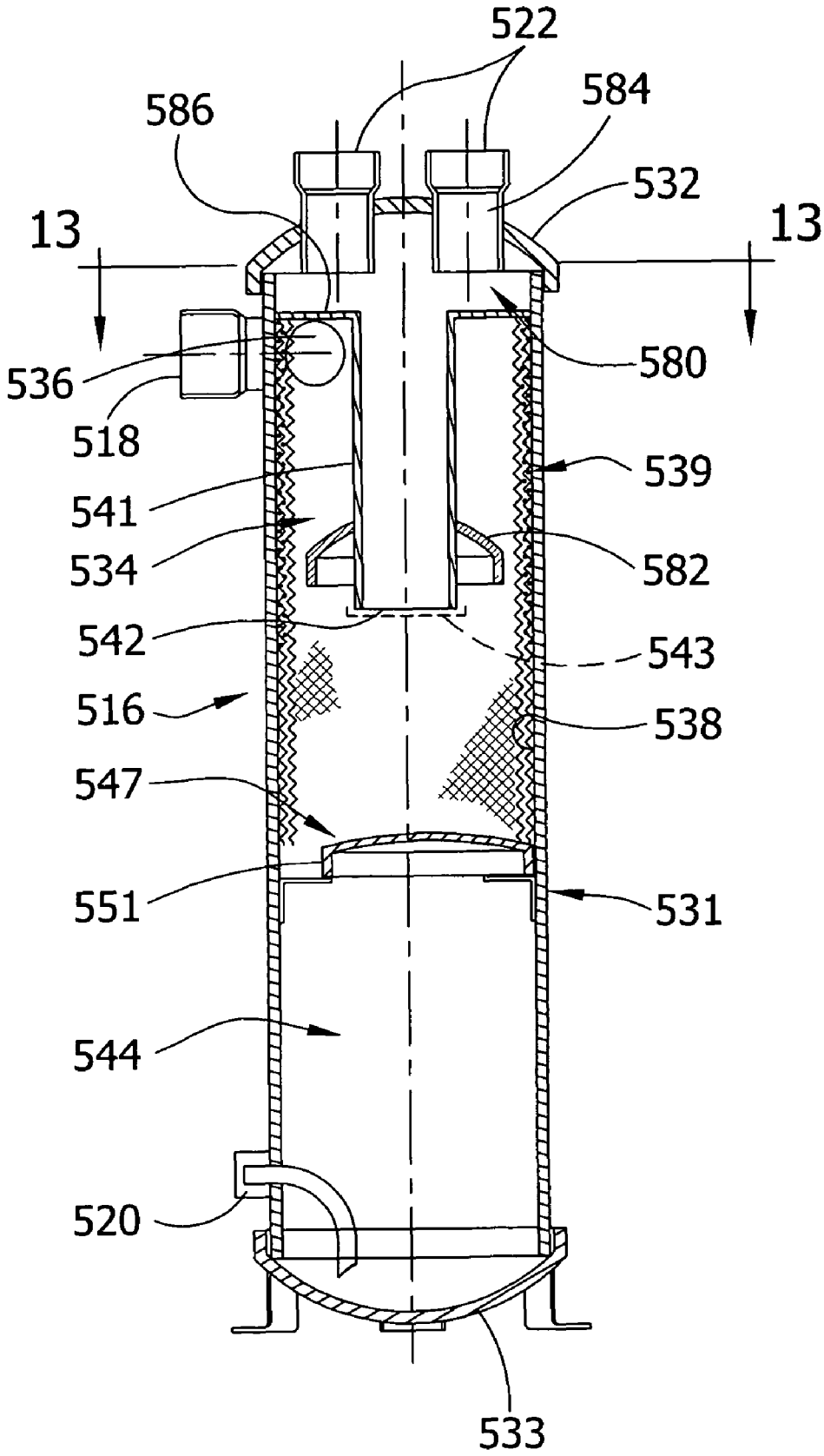
FIG. 12 is a cross-sectional view of an oil separator having multiple refrigerant gas discharges.
Figure 13:
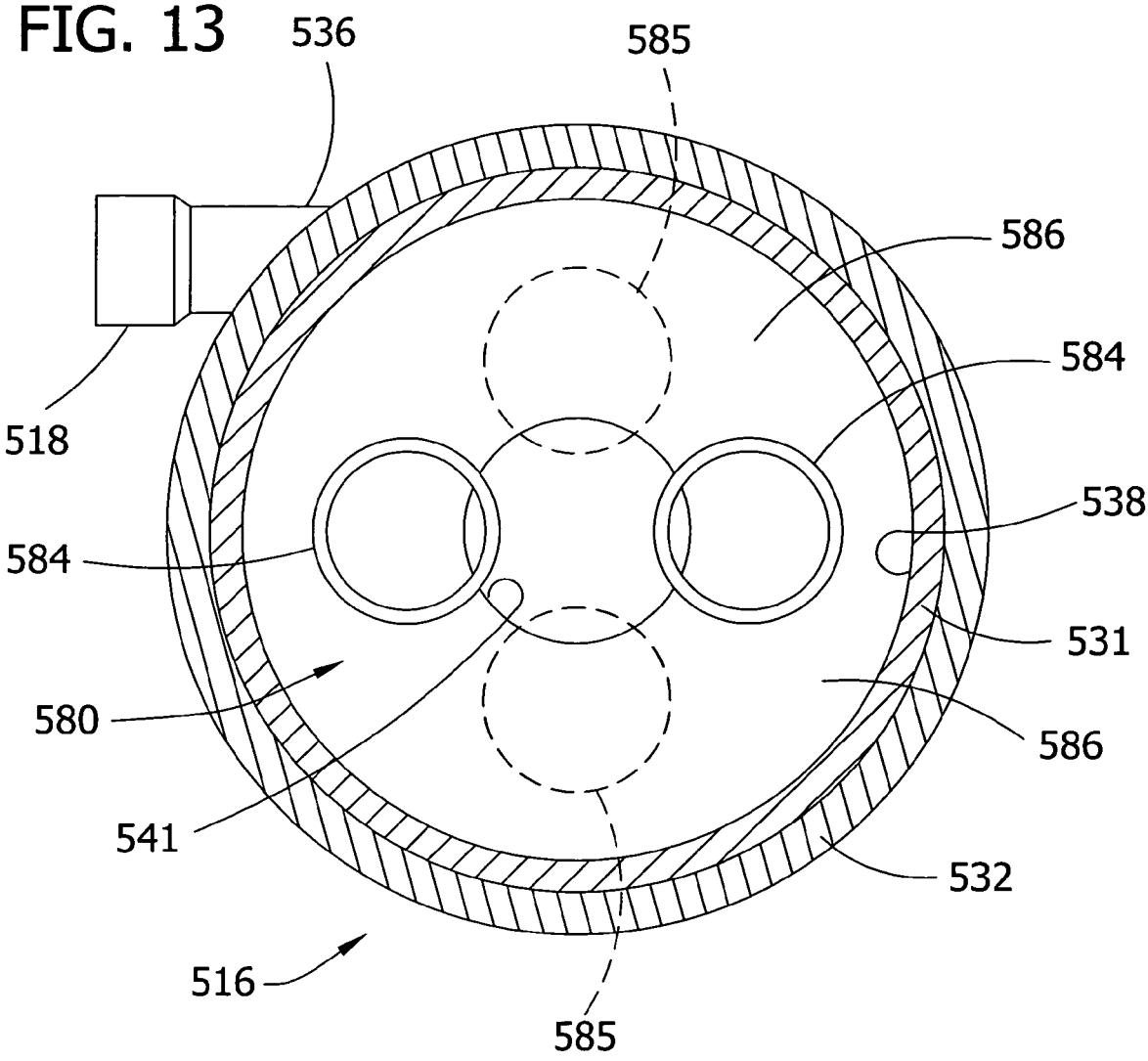
FIG. 13 is an enlarged sectional view taken along line 13-13 of FIG. 12.

Referring now to FIGS. 12 and 13, a preferred embodiment of the oil separator 516 is most similar to the embodiment of FIG. 5 except that its cross-sectional dimension of the upper vapor receiving and oil separating chamber 534 is substantially larger (e.g. ten inch diameter versus a six inch diameter of the FIG. 5 embodiment). This accommodates the larger volume of refrigerant-oil vapor mixture received through the inlet 518 and discharged tangentially against the mesh oil separating filter 539 lining the inner wall surface 538 of the oil separator outer wall 531. The inlet pipe 536 from inlet 518 as shown is preferably welded to the body casing and this pipe 536 may extend into the upper chamber 534 and be angle-cut as shown in the FIG. 2 or 5 embodiments. This larger diameter also provides the potential for a larger volume oil reservoir in the lower section 544. As in FIG. 5, a double wrap or dual thickness filter liner (539) may be provided. The upper oil separating section 534 and lower oil reservoir section 544 are separated by a domed baffle member 547 asymmetrically attached to the sidewall 531 to provide the crescent-shaped oil by-pass passage 551 along one side.

A refrigerant vapor outlet passageway is defined by a central conduit 541 connected to open into a large refrigerant gas outlet chamber 580 disposed at the top of the separator housing 530 under upper end cap 532. The conduit 541 has a gas intake end 542 in the intermediate zone of the upper section below the intake 536 for the gas/oil mixture into the upper oil separation zone. It may be desirable to provide a screen filter 543 (as shown in dashed lines in FIG. 12). Another feature is the provision of a drip ring 582 attached to circumscribe the gas outlet conduit 541 above the inlet 542 thereto whereby any liquid oil accumulating on the conduit wall in the separation chamber 534 will be diverted outwardly toward the side wall 538 and oil entrainment into the gas outlet 542 will be substantially eliminated. It may be noted that the drip ring 582 has a domed upper wall and the peripheral side wall forms a narrowed passageway with the side wall 538.

The upper refrigerant gas outflow chamber 580 has the outlet or gas discharge connectors 522 arranged to communicate with the high side system conduits 521 leading to the respective condenser circuits 515. Thus, a short conduit 584 from each outlet 522 is secured to end cap 532 and extends into the upper gas discharge chamber 580 and the free open ends thereof accommodate the unrestricted outflow of refrigerant gas to the condenser 514. It will be noted that the bottom wall 586 of the chamber 580 connects to the housing wall 531 as by welding and it may slope downwardly to connect to the central outlet tube 541 whereby any possible accumulation of liquid oil on the chamber surfaces will drain back down the conduit 541. The oil separator of the invention has at least two gas outlets 522 connected to the condenser means 514 of the system 510, and the enlarged upper outlet chamber 580 will accommodate additional outlet connections as indicated in broken lines at 585 in FIG. 13.

From the foregoing it will be evident that the oil separator of the present invention provides a greatly improved and simplified oil separation and reservoir apparatus that meets the objects set forth. The scope of the invention encompasses such changes and modifications as will be readily apparent to those skilled in the art and within the scope of the appended claims.

What is claimed is:

1. An oil separator for separating the oil and refrigerant gas from the high pressure mixture thereof discharged from the compressor in a refrigeration/chiller system having multiple condenser circuits, said oil separator comprising:

a housing having an upper section defining an upper oil separation chamber and a lower section defining a lower oil reservoir, the housing having an upper end cap closing an upper end of the housing, means for creating a turbulent circulating flow of the mixture in the upper chamber and for filtering the oil therefrom, baffle means between the oil separation chamber and the oil reservoir—and being constructed and arranged for producing substantially non-turbulent flow of liquid oil into the lower oil reservoir, and at least two separate refrigerant gas outlet ports in fluid communication with the oil separation chamber adapted to deliver exclusively refrigerant gas to at least two separate condenser circuits in the refrigeration/chiller system, the refrigerant gas outlet ports having no intersection with each other and extending through the upper cap of the upper section of the housing at spaced apart locations in the upper cap.

2. The oil separator of claim 1, in which said means for filtering comprises a mesh liner positioned in the upper chamber for receiving and holding oil particles and producing a downward liquid oil flow past the baffle means into the lower oil reservoir.

3. The oil separator of claim 2, in which the means for creating a turbulent circulating flow comprises a high side inlet for fluid communication with the compressor and for angling the inlet flow of the mixture to impinge against the mesh liner in the upper oil separation chamber.

4. The oil separator of claim 3, in which said high side inlet is constructed and adapted for receiving a high volume discharge output of multiple compressors.

5. The oil separator of claim 1, further comprising a refrigerant gas discharge conduit inside the housing and fluidly connecting the upper oil separation chamber to said at least two separate refrigerant gas outlet ports.

6. The oil separator of claim 5, in which said refrigerant gas discharge conduit has a gas intake opening communicating with the upper oil separation chamber, and further comprising other oil filtering means for removing oil particles from circulating flow in the upper oil separation chamber.

7. The oil separator of claim 5, which includes a refrigerant gas outflow chamber connected between the gas discharge conduit in the upper oil separation chamber and the refrigerant gas outlet ports to deliver gas to the condenser circuits.

8. The oil separator of claim 6, in which said other oil filtering means comprises a screen filter covering the gas intake opening to said gas discharge conduit.

9. The oil separator of claim 6, which includes a drip ring circumscribing the gas discharge conduit and having an angled upper wall to shed liquid oil flow outwardly away from the gas intake opening therebelow, said drip ring having a substantial circumferential spread in the direction of the upper oil separation chamber sidewall to thereby narrow the circulatory flow path and reduce turbulence above the gas intake opening of the discharge conduit.

10. A vertical oil separator for generating oil from a refrigerant gas and oil discharged thereto from a refrigeration/chiller system compressor comprising:

a housing having an upper section forming an oil separation chamber with an inlet constructed and arranged for receiving the refrigerant gas and oil mixture from the system compressor and for creating a spiraling flow path in the upper section, an oil filter in the oil separation chamber for removing oil particles from the spiraling flow path of the gas and oil mixture, and a refrigerant gas outlet conduit within the upper section for conveying refrigerant gas therefrom, the housing having an upper end cap closing an upper end of the housing, said housing also having a lower section forming an oil receiving chamber below the upper section, said lower section having an oil outlet for the return of oil to the system compressor, at least two separate refrigerant gas outlet ports in fluid communication with the gas outlet conduit, the outlet ports being adapted to deliver exclusively refrigerant gas to at least two separate condenser circuits in the refrigeration/chiller system, the refrigerant gas outlet ports having no intersection with each other and extending through the upper end cap of the upper section of the housing at spaced apart locations in the upper end cap.

11. The oil separator of claim 10, in which the inlet for receiving the refrigerant gas and oil mixture into the upper oil separation chamber is sized to accommodate a high volumetric input as discharged by multiple compressors in the refrigeration/chiller system.

12. The oil separator of claim 11, which includes means for restricting the turbulence of the spiraling flow in the upper oil separation chamber.

13. The oil separator of claim 12, in which said means for restricting comprises a drip ring constructed and arranged to circumscribe the gas outlet conduit and extend outwardly therefrom to form a restricted flow path therepast.

14. The oil separator of claim 10 further comprising a wall attached to the housing and defining a discharge chamber in the upper section, the gas outlet conduit extending generally from the wall downwardly in the housing and in fluid communication with the discharge chamber through the wall, the conduit being free of any portion extending above the wall, the refrigerant gas outlet ports opening into the discharge chamber.

15. The oil separator of claim 14 wherein the discharge chamber wall is attached to the housing by welding.

16. The oil separator of claim 10 wherein the refrigerant gas outlet conduit has an open bottom and an open top, each of the refrigerant gas outlet ports being at least partially in vertical registration with the open top of the gas outlet conduit.

17. In a refrigeration system having at least one compressor and multiple condenser circuits including multiple condensers, an oil separator constructed and arranged to receive the high pressure refrigerant gas and oil output discharged from the compressor and to separate out the oil from the refrigerant gas for return to the compressor, and said oil separator comprising a housing having an upper section defining an upper oil separation chamber, a lower section defining a lower oil reservoir, an upper end cap closing an upper end of the oil separator and two refrigerant gas outlet ports having no intersection with each other and extending through the upper end cap of the oil separator at spaced apart locations, the refrigerant gas outlet ports being connected to deliver exclusively the separated refrigerant gas to the condenser circuits, the refrigerant gas outlet ports extending through an upper section of the oil separator.

18. The refrigeration system of claim 17 wherein the oil separator comprises a housing having an inlet therein in fluid communication with the compressor for receiving the high pressure refrigerant gas and oil output from the compressor, an oil outlet in a bottom section of the oil separator for discharging collected oil from the oil separator, a wall attached to the housing and defining a discharge chamber in the upper section, and a conduit extending generally from the wall downwardly in the housing and in fluid communication with the discharge chamber through the wall, the conduit being free of any portion extending above the wall, the refrigerant gas outlet ports opening into the discharge chamber.

19. The refrigeration system of claim 18 wherein the discharge chamber wall is attached to the housing by welding.

20. The refrigeration system of claim 17 wherein the oil separator comprises a housing having an inlet therein in fluid communication with the compressor for receiving the high pressure refrigerant gas and oil output from the compressor, an oil outlet in a bottom section of the oil separator for discharging collected oil from the oil separator, a conduit supported in the housing and extending generally lengthwise of the housing, the conduit have an open bottom for receiving refrigerant gas and an open top for discharging, each of the refrigerant gas outlet ports being at least partially in vertical registration with the open top of the conduit.

* * * * *